United States Patent [19]

Alig et al.

[11] 4,335,366

[45] Jun. 15, 1982

[54] COLOR TELEVISION DISPLAY SYSTEM HAVING IMPROVED CONVERGENCE

[75] Inventors: Roger C. Alig, Princeton Junction; William H. Barkow, Pennsauken; Josef Gross, Princeton, all of N.J.

[73] Assignee: RCA Corporation, New York, N.Y.

[21] Appl. No.: 119,132

[22] Filed: Feb. 25, 1980

[51] Int. Cl.[3] ..... H01F 3/12; H01F 7/00

[52] U.S. Cl. ..... 335/211; 335/214

[58] Field of Search ..... 335/211, 212, 214; 313/440

[56] References Cited

U.S. PATENT DOCUMENTS

| | | | |
|---|---|---|---|
| 2,227,711 | 1/1941 | Gunther | 335/214 |
| 2,935,635 | 5/1960 | Boothroyd et al. | 313/440 |
| 3,019,361 | 1/1962 | Di Paolo | 335/214 |
| 3,020,434 | 2/1962 | Bloomsburgh | 313/440 |
| 3,505,560 | 4/1970 | Marvin | 335/211 |
| 3,913,043 | 10/1975 | Paridaens | 335/212 |
| 4,034,324 | 7/1977 | Sano et al. | 335/212 |
| 4,237,437 | 12/1980 | Vink et al. | 335/211 |
| 4,246,560 | 1/1981 | Shimizu et al. | 335/212 |

FOREIGN PATENT DOCUMENTS 2010005 11/1978 United Kingdom .

*Primary Examiner*—Harold Broome

*Attorney, Agent, or Firm*—E. M. Whitacre; P. J. Rasmussen; S. J. Stevens

[57] ABSTRACT

In a television receiver comprising a display system incorporating a kinescope having horizontal in-line electron beams and also incorporating a deflection yoke having toroidally-wound vertical deflection coils, where the kinescope utilizes a magnetically-permeable G3 focussing electrode in the electron guns to reduce deflection defocussing, an arrangement for correcting misconvergence of the electron beams caused by the magnetically-permeable G3 electrode comprises a pair of magnetically-permeable field formers disposed along and extending toward the rear of the yoke. The field formers are configured to collect a portion of the external fields generated by the vertical windings and direct those portions through the kinescope neck substantially at right angles to the electron beams in the vicinity of the exit end of the electron guns with a barrel-shaped transverse pattern.

5 Claims, 7 Drawing Figures

COLOR TELEVISION DISPLAY SYSTEM HAVING IMPROVED CONVERGENCE

This invention relates to an arrangement for improving electron beam convergence of a color television display through the use of magnetically-permeable field formers to counteract beam misconvergence caused by stray deflection field flux in the vicinity of the electron gun assembly.

The majority of current color television receivers utilize a picture tube having three horizontally in-line electron guns. This type of tube allows the use of self-converging deflection yokes which substantially converge the three electron beams at all points on the tube display screen without the use of dynamic convergence magnets or circuits.

One type of self-converging yoke comprises a pair of toroidally-wound vertical deflection coils, wound around a magnetically-permeable core, and a pair of saddle-wound horizontal deflection coils. This is often referred to as a semitoroidal yoke. Other combinations of vertical and horizontal windings are, of course, possible.

In the semitoroidal yoke just described, the two toroidal coils are located above and below the electron gun horizontal plane. The coils are connected in opposition such that flux generated in the core by one coil opposes the flux generated by the other coil. As a result, a mainly horizontally-directed magnetic field is formed from one side of the core to the other through the volume bounded by the core. This horizontally-directed field deflects the three electron beams in a vertical direction. The flux opposition between the vertical toroidal coils in the core also causes the formation of an external stray field or external leakage flux. The energy in this stray field is not used in deflecting the beams; therefore it increases power consumption and reduces the energy efficiency of the yoke.

The nature of the toroidal windings also causes a portion of the internal deflection field to spill out the back of the yoke. This spillover fringe field creates problems in the manufacture of short tubes in which the electron gun assembly is desirably as close to the screen as possible. Tubes of this type position the electron gun assembly near the deflection yoke, which locates the gun assembly within the spillover deflection field generated by the toroidal vertical deflection windings. Field spillover occurs to a lesser degree from saddle-type coils. If the spillover field is present in the low voltage, i.e., low-beam-velocity region of the electron gun assembly, beam deflection defocussing can occur. Deflection defocussing results when the spillover back field begins to deflect the electron beams prior to and within the main focussing lens of the electron gun assembly. This causes an overfocussing of the leading rays of each beam and results in a lagging flare on the displayed beam spots.

Defocussing of the electron beams by spillover fields from the toroidal vertical deflection coils can be reduced by forming at least a portion of the electrostatic focus electrode (referred to as the G3 electrode) in the electron gun assembly from a magnetically-permeable material. This "magnetic" G3 electrode shunts the spillover deflection field away from the volume traversed by the beams, thereby greatly reducing the field's effect on the beams. In the process of shunting the deflection field away from the electron beams, the magnetically-permeable G3 electrode also distorts the transverse pattern of the field, so that a pincushion-shaped field is formed in the exterior and in front of the G3 electrode. In a self-converging yoke for an in-line electron gun assembly, the overall contribution of the nonuniformity function of the vertical deflection field is that of a barrel-shaped field. The pincushion-shaped field pattern formed by the distortion caused by the magnetic G3 electrode reduces the overall barrel field contribution of the vertical deflection field. Since a barrel-shaped vertical deflection field tends to underconverge the outer two beams at the ends of the minor axis while a pincushion field tends to overconverge them, an increase in the pincushion field contribution of the overall nonuniformity function caused by the magnetic G3 electrode causes an overconvergence of the outer two electron beams at the ends of the display screen vertical axis. Reconfiguring the vertical winding to generate a stronger barrel-shaped field can correct this overconvergence, but it produces an undesirable increase in N-S pincushion distortion.

In accordance with this invention, there is provided a color television display system having a horizontal in-line electron gun assembly incorporating a magnetically-permeable G3 electrode. A pair of beam convergence-correcting field formers or shunts are disposed along the yoke core on opposite sides of the yoke. The field formers are configured to recover a portion of the stray magnetic flux generated by the toroidal vertical deflection coils and channel that flux into the vicinity of the exit end of the electron gun assembly. This channelled flux causes some vertical deflection of the electron beams, thereby reducing the vertical deflection power consumed by the yoke. The field formers are also configured to form a generally barrel-shaped field at the entrance region of the yoke to compensate for the undesirable pincushion field generated by the magnetic G3 electrode, thereby correcting for overconvergence of the outer electron beams at the ends of the kinescope minor axis.

Figure 1:
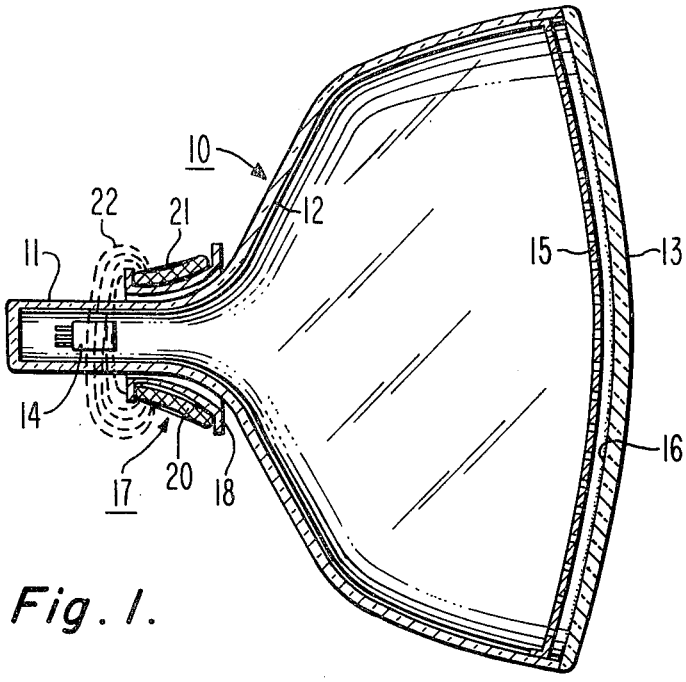
FIG. 1 is a top cross-sectional view of a color television display system illustrating a representation of the spillover vertical deflection field.

Referring to FIG. 1, there is shown a color television kinescope 10 comprising a glass envelope made up of a cylindrical neck region 11, a funnel portion 12, and a front panel 13. Disposed within the neck region 11 is an electron gun assembly 14 incorporating means for producing three horizontal in-line electron beams. The beams pass through a shadow mask 15 disposed adjacent to the front panel 13 and impinge upon red, green and blue color-producing vertical phosphor strips 16, which are applied to the front panel 13 to form the kinescope display screen. The shadow mask 15 is made up of a great number of small apertures, such as vertically extending slots. The shadow mask 15 ideally allows the red, green and blue designated electron beams to impinge upon only their respective color-producing phosphor strips. Disposed about the exterior of the kinescope 10 in the region where the neck 11 and funnel 12 are joined is a deflection yoke 17. The yoke 17 comprises a magnetically-permeable core 20, a pair of toroidally-wound vertical deflection coils 21 wound about the core 20, a pair of saddle-wound horizontal deflection coils (not shown), and coil insulator 18. Yoke 17 is designed to be self-convergent; that is, the three electron beams are substantially converged at all points on the kinescope display screen, without the need for dynamic convergence correction. This is accomplished by configuring the horizontal and vertical windings to have an overall nonuniformity function (commonly referred to as $H_2$) that is nonzero. For horizontal in-line electron beams, this requires the horizontal deflection field to have an overall pincushion-shaped nonuniformity while the vertical deflection field is barrel-shaped overall. It should be understood that this is the overall net nonuniformity and does not describe the local nonuniformity function at a particular location along the deflection axes. The horizontal and vertical windings may also be configured to provide correction for deflection-related distortion and convergence errors, such as coma, N-S pincushion distortion and E-W pincushion distortion.

As can be seen in FIG. 1, a portion of the vertical deflection field 22 extends from the rear of yoke 17. This occurs because toroidally-wound coils generate more extensive fringe fields than do saddle-wound coils. The spillover or fringe field from the vertical coils presents problems in the design of tubes having desirably short necks, which necessitates placing the electron gun assembly close to the deflection yoke. When the electron gun assembly is located within the region occupied by the spillover vertical deflection field as shown in FIG. 1, this can result in deflection of the electron beams within the electron gun assembly by the spillover vertical deflection field. The beams may be deflected slightly prior to their being focussed by the electrostatic focussing lens of the electron gun assembly. This deflection causes the beams to traverse the focussing fields slightly off center, resulting in an asymmetrical focussing of the beam. This condition, occurring during deflection of the beams, results in a distortion of the beam spot, causing a reduction in picture resolution and sharpness.

Figure 3:
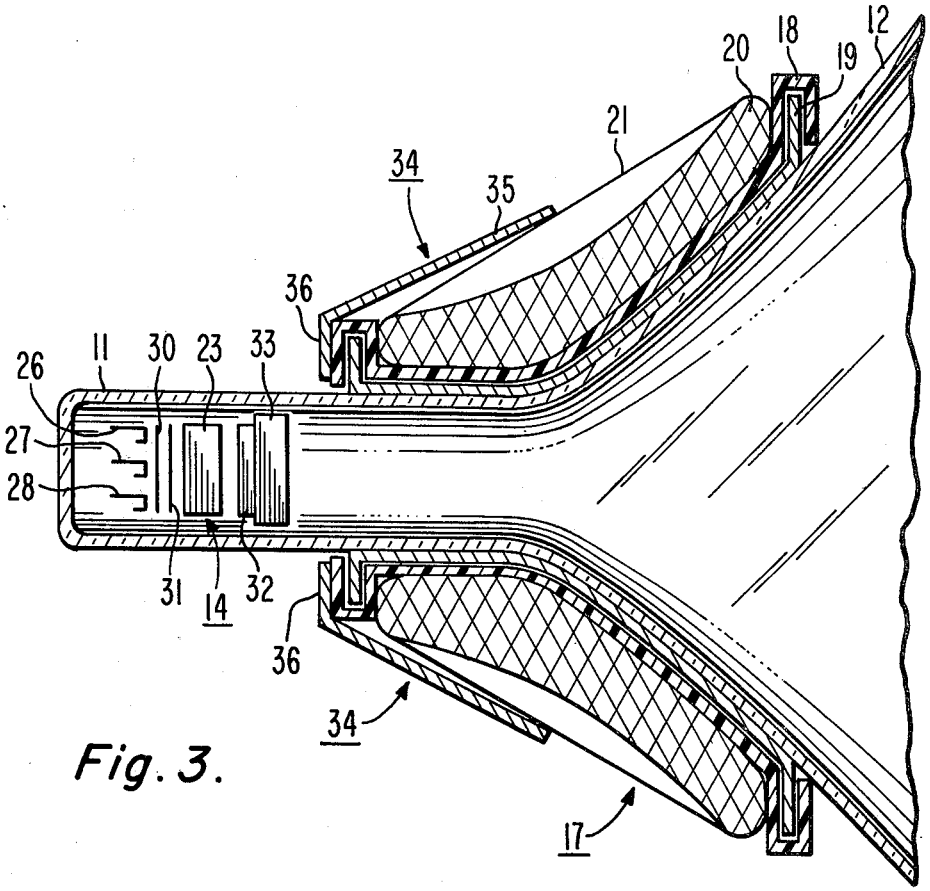
FIG. 3 is a top cross-sectional view of a portion of a color television display system in accordance with the present invention.

It has been found that interaction between the electron beams within the electron gun assembly 14 and the spillover vertical deflection field 22 can be appreciably reduced by forming the first accelerating and electrostatic focussing electrode 23 (referred to as the G3 electrode), shown in FIG. 3, of the electron gun assembly 14 from a material having high magnetic permeability. The magnetic electrode 23 then shunts the spillover deflection field away from the electron beams, greatly reducing deflection defocussing.

Figure 2:
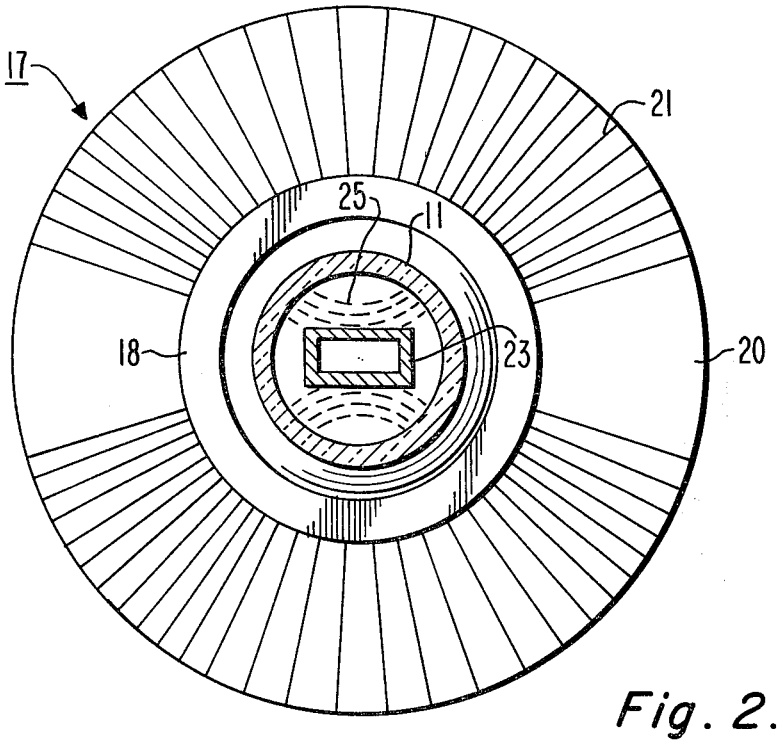
FIG. 2 is a rear cross-sectional view of a colorr television kinescope illustrating the vertical deflection windings and the orientation of selected components of the vertical deflection field.

Referring to FIG. 2, the effect of this shunting on the deflection field can be seen. FIG. 2 is a cross-sectional view of the color television display system from the back of yoke 17 looking forward toward the screen. The vertical deflection coil 21 is shown as having radial windings, but coils having nonradial or biased windings may also be used. The magnetic focussing G3 electrode 23 and a representation of the vertical deflection field lines of force 25 can be seen within the tube neck 11. The high permeability of the magnetic material of which electrode 23 is formed presents a low-reluctance path for the surrounding spillover vertical deflection field, causing electrode 23 to shunt the deflection field through the high permeability material and away from the electron beams. This shunting causes a distortion of field lines 25 in FIG. 2. Electrode 23 may consist of two portions, with only one portion having high permeability. The effect of electrode 23 is to cause the field lines 25 at the exit of electrode 23 to be distorted into a pincushion-shaped field. This pincushion field contributes to the overall vertical deflection field nonuniformity function, causing the outer two electron beams (red and blue) to become overconverged at the ends of the vertical or minor axis or the kinescope screen. An increase in pincushion character of a self-converging field therefore would tend to overconverge the beams along the vertical axis of deflection, and be most noticeable at the ends of the axis.

Figure 4A:
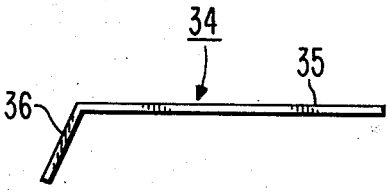
FIGS. 4A and 4B are top and side views, respectively, of a magnetic field shunt in accordance with the present invention.
Figure 4B:
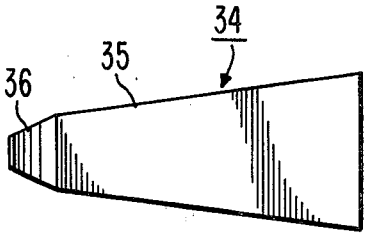
Figure 5:
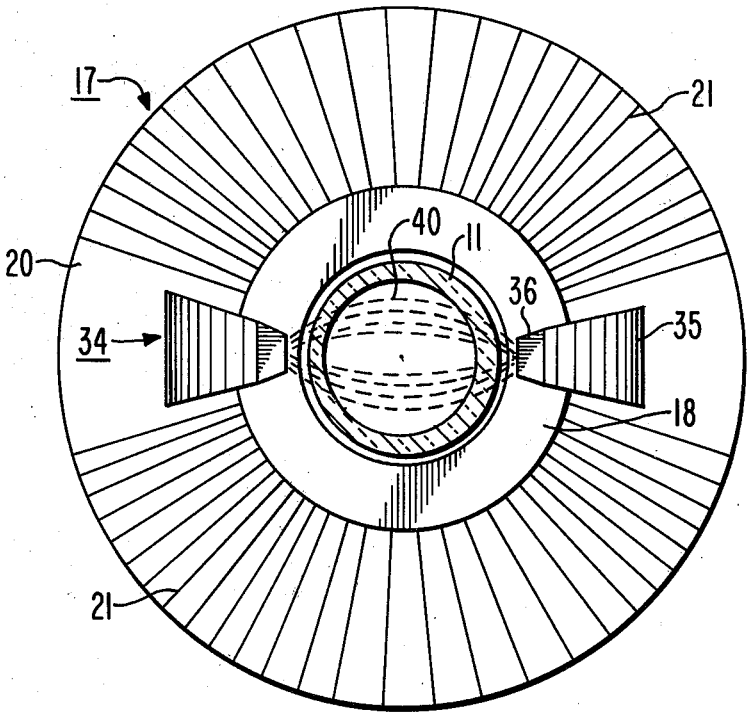
FIG. 5 is a rear cross-sectional view of a color television display system illustrating the operation of the magnetic field shunts in accordance with the present invention.

Referring to FIGS. 3–5, a solution according to the invention to this overconvergence will be described. As stated previously, it is undesirable to compensate for the pincushion field generated by electrode 23 by merely reconfiguring the vertical windings to create a stronger barrelled vertical deflection field. The increase in barrelling of the main deflection field causes an increase in North-South raster pincushion distortion, the correction of which may cause gullwing distortion at the edges of the raster. FIG. 3 illustrates an enlarged view of a portion of a kinescope and yoke assembly similar to that shown in FIG. 1. Corresponding elements will carry corresponding numerical designations. Electron gun assembly 14, shown in more detail, comprises three horizontally-disposed cathode assemblies 26, 27 and 28 for generating the red, green and blue designated electron beams. Adjacent to the cathode assemblies 26, 27 and 28 is disposed a control grid 30. Adjacent to the control grid 30 is a screen grid 31. Adjacent to screen grid 31 is the first accelerating and focussing electrode 23, previously described. The electron gun assembly 14 also comprises a second accelerating and focussing electrode 32 adjacent to electrode 23. Electrode 23 is mounted to a shield cup 33. The electrons generated by cathode assemblies 26, 27 and 28 pass through apertures (not shown) in grids 30 and 31, and electrodes 23 and 32. Additional means for mounting the electron gun components together and to the kinescope 10 are not shown, but it is to be understood that they are conventional. A detailed description of the construction and operation of an electron gun can be found U.S. Pat. No. 3,772,554—Hughes.

FIG. 3 also illustrates the invention comprising the addition of magnetic field formers or shunts 34, located on opposite sides of yoke 17. The structure of field formers 34 is shown in FIGS. 4A and 4B. Field formers 34 are formed of a material having a high magnetic permeability. An elongated portion 35 of field formers 34 lies adjacent to the core 20 of yoke 17 in the space between coils 21, and extends from the core 20 toward the back of the yoke 17. Elongated portion 35 is illustrated in FIGS. 4A and 4B as decreasing in width as it extends toward the rear of yoke 17. As elongated portion 35 reaches the rear of the yoke, field formers 34 are angled or bent toward tube neck 11, so that they are perpendicular with tube neck 11. The angled portions 36 of field formers 34 are also decreasingly tapered as they extend toward tube neck 11. Portion 36 terminates adjacent to tube neck 11 at the rear of the yoke in the vicinity of the exit end of electron gun assembly 14.

Figure 3A:
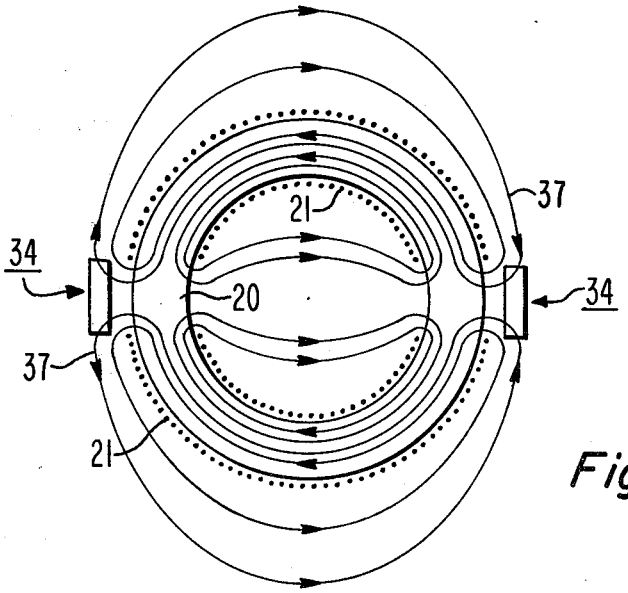
FIG. 3A is a cross-sectional view of a representation of the vertical deflection coils illustrating the vertical deflection field lines.

Referring to FIGS. 3A and 5, the operation of shunts 34 will now be described. FIG. 3A illustrates a representation of the useless external field that is generated by the vertical deflection coils 21. This external field region is shown by field lines 37. The high magnetic permeability of field formers 34 presents a path of low magnetic reluctance to magnetic flux, which conducts a portion of the external field flux into field formers 34. A portion of the rear spillover field flux may also be conducted into field formers 34. This flux is conducted along the elongated portions 35 of field formers 34 to the end of portions 36. A magnetic field is then formed between portions 36 of field formers 34 across the interior of tube neck 11, substantially at right angles to the electron beams as shown by field lines 40 in FIG. 5. Because the field emanates and terminates at the relatively narrow ends of portions 36, the field lines at those points will be fairly concentrated. Between those points, the field will expand, creating a barrel-shaped field. This barrel field provides a diverging effect on the electron beams in order to compensate for the beam overconvergence caused by the magnetically-permeable electrostatic focussing electrode 23. The configuration of the field formers 34 can be varied to give the desired shape and strength to the compensating barrel field. For example, decreasing the length and width of the elongated portion 35 will decrease the amount of the external field that is shunted, thereby reducing the strength of the barrel field generated. The field formers may also be made of uniform width, rather than tapered. The configuration and position of field formers 34, therefore, is intended to be only exemplary and the actual size, shape, and orientation of the field formers in actual application will of course be variable to the extent necessary to provide an appropriate compensating magnetic field.

What is claimed is:

1. In a television receiver comprising a kinescope having a neck region, a display screen and an intermediate funnel region; a deflection yoke, disposed about said kinescope neck and funnel region, having a pair of vertical deflection coils toroidally-wound about a core, said coils producing a magnetic deflection field comprising a portion located within the interior of said yoke and an external portion located within a first field region generally disposed at the rear of said yoke, and within a second field region generally disposed at the sides of said yoke; an electron gun assembly for producing three horizontal in-line electron beams, disposed within said kinescope neck region in the vicinity of said first field region, said electron gun assembly incorporating a magnetically-permeable focusing electrode for reducing defocusing of said beam caused by said field located in said first external field region, said magnetically-permeable electrode interacting with said field located within said first external field region in a manner tending to cause overconvergence of said electron beams at the ends of the minor axis on said kinescope display screen in the absence of compensation therefor; compensation apparatus comprising:

a pair of magnetically-permeable field formers located on opposite sides of said yoke, each comprising a first elongated portion disposed adjacent said yoke within said second external field region, and a second portion angled with respect to said first portion; each of said second field former portions having a termination disposed adjacent to said kinescope neck in the vicinity of the exit end of said electron gun assembly for causing interaction of said electron beams with a magnetic field formed between said second field former portions in a manner compensating for said overconvergence.

2. The apparatus defined in claim 1, wherein said magnetic field formed between said second field former portions has a barrel-shaped flux distribution pattern transverse to said beams.

3. A display system comprising:

a kinescope incorporating a neck region, a display screen and an intermediate funnel region;

electron gun apparatus disposed within said kinescope neck for producing three horizontal in-line electron beams;

a deflection yoke, disposed about said kinescope neck and funnel regions, comprising vertical deflection coils toroidally-wound about a core, said coils producing a deflection field having magnetic flux located within the interior of said yoke for effecting deflection of said beams in a vertical direction, and leakage flux located external to said yoke;

magnetically-permeable means, located adjacent to the exterior of said yoke, for channelling a portion of said leakage flux beyond the rear of said yoke to the vicinity of the exit end of said electron gun apparatus for forming a barrel-shaped magnetic field at said exit end for interaction with said electron beams.

4. The display system defined in claim 3, wherein said flux channelling means is configured to form said magnetic field at said exit end with an orientation effecting vertical deflection of said electron beams at said electron gun apparatus exit end in a manner supplementing the beam deflection effected by said flux located within the interior of said yoke.

5. In a television receiver comprising a kinescope having a neck region, a display screen and an intermediate funnel region; a deflection yoke disposed about said kinescope neck and funnel region having a pair of vertical deflection coils toroidally-wound about a core, said coils producing a magnetic deflection field comprising a portion located within the interior of said yoke and an external portion located within a first field region generally disposed at the rear of said yoke, and within a second field region generally disposed at the sides of said yoke; an electron gun assembly for producing three horizontal in-line electron beams, disposed within said kinescope neck region in the vicinity of said first field region, said electron gun assembly incorporating a magnetically-permeable focusing electrode for reducing defocusing of said beams caused by said beams interacting with said field located within said first external field region, said magnetically-permeable electrode interacting with said field in said first external field region to form a resultant pincushion-shaped magnetic field, said pincushion field interacting with said electron beams in a manner tending to cause overconvergence of said electron beams at the ends of the minor axis on said kinescope display screen in the absence of compensation therefor; compensation apparatus comprising:

a pair of magnetically-permeable field formers located on opposite sides of said yoke, each comprising a first elongated portion disposed adjacent said yoke within said second external field region and a second portion angled with respect to said first portion, each of said second field former portions having a termination disposed adjacent to said kinescope neck in the vicinity of the exit end of said electron gun assembly for generating a barrel-shaped magnetic field between said second portions, said barrel field interacting with said electron beams in a manner compensating for said overconvergence of said electron beams.

* * * * *